United States Patent [19]

Colleran et al.

[11] Patent Number: 4,968,270

[45] Date of Patent: Nov. 6, 1990

[54] SPRING BULB SOCKET

[75] Inventors: Stephen Colleran, Lisle; Robert Gugelmeyer, Aurora, both of Ill.

[73] Assignee: Molex Incorporated, Lisle, Ill.

[21] Appl. No.: 441,674

[22] Filed: Nov. 27, 1989

[51] Int. Cl.[5] ..... H01R 33/06

[52] U.S. Cl. ..... 439/699

[58] Field of Search ..... 439/699, 856, 857, 861, 439/862

[56] References Cited

U.S. PATENT DOCUMENTS 4,473,770 9/1984 Baba et al. ..... 439/699

4,894,027 1/1990 Brantingham et al. ..... 439/699

*Primary Examiner*—Joseph H. McGlynn

*Attorney, Agent, or Firm*—Louis A. Hecht; Stephen Z. Weiss; Charles S. Cohen

[57] ABSTRACT

A socket assembly is provided for low wattage bulbs. The socket assembly includes a nonconductive housing with a pair of electrically conductive terminals therein. The housing includes an inwardly directed shoulder adjacent the forward mating end an inwardly disposed locking structure. The terminals include inwardly directed locking tangs, the alignment of which prevents unintentional deformation prior to insertion of the terminal into the housing. Each terminal also includes a pair of contact beams angularly aligned toward one another. Portions of the contact beams are concave from side to side to contribute to alignment of the conductive leads of the bulb. The terminals also include tuning fork assist structures extending from an intermediate portion of the terminal forwardly for contact with the extreme forward mating end of each contact beam.

10 Claims, 5 Drawing Sheets

SPRING BULB SOCKET

BACKGROUND OF THE INVENTION

Many electrical devices include very low wattage bulbs which are slidably insertable into a socket. Bulbs of this type are used, for example, in many automotive applications, including the illumination for automotive dashboard components. Bulbs of this type typically include a generally rectangular base having a bottom end face from which a pair of electrically conductive leads extend. The leads are small and flexible and are bent in opposite directions to lie generally adjacent opposed front and rear faces of the rectangular bulb base. The illuminating filaments of the bulb are disposed in a standard transparent enclosure which typically is generally cylindrical in configuration. The bulb is slidably insertable into a socket and is frictionally retained therein. More particularly, the prior art socket typically includes a housing having a mating aperture dimensioned to receive the base of the bulb. The prior art socket further includes a pair of terminals therein disposed and configured to engage the conductive leads of the bulb. The terminals disposed in the housing of the prior art socket are mounted appropriately to conductive wire leads which extend to other circuitry in the electrical apparatus or vehicle.

Bulb and socket combinations of this type generally are very small, very inexpensive structures. The typical socket housing for a bulb of this type will be less than one inch long and less than one half inch wide. The terminals mounted in the housing for these applications may typically be less than one-half inch long, while the socket of the typical bulb may define a cross-section of approximately 0.2 inch by 0.1 inch. Despite these small dimensions, it is desirable for the terminals to exert an acceptably high contact force against the conductive leads of the bulb. It is also desirable to provide secure positive locking of the terminals within the housing and to ensure that the housing adequately protects the small, fragile terminals.

Many prior art bulb sockets of this general type have created the potential for damage or ineffective electrical contact if the bulb is improperly aligned during insertion into the socket. More particularly, many prior art sockets of this type create the risk of the bulb base being inserted on the wrong side of the terminal, such that the terminal in the socket housing is overstressed and achieves an improper or ineffective electrical contact with the bulb.

In many instances, the small, fragile, flexible leads extending from the bulb are bent or misaligned prior to or during insertion into the socket. These improperly aligned conductive leads of the bulb could be misaligned with the corresponding terminal in the socket. As a result, the terminals of the prior art socket may not contact the leads of the bulb or may achieve unacceptably low contact forces therewith. In still other instances, the insertion of the prior art terminals into the socket housing have caused damage to the prior art terminals. In particular, the means for locking the prior art terminals into the socket housing often are aligned to permanently damage the terminals during the insertion process. This damage generally will occur after the costly termination work has been completed.

Examples of prior art bulb sockets include U.S. Pat. Nos. 4,804,343 and 4,624,524. The prior art further includes many references to terminals that could be incorporated into housings for receiving bulbs of this type.

In view of the above, it is an object of the subject invention to provide a bulb socket that ensures adequate electrical contact with the leads of a bulb inserted therein.

It is another object of the subject invention to provide a bulb socket for properly aligning the bulb leads with the terminals of the socket.

A further object of the subject invention is to provide a bulb socket that prevents overstress of the terminal contact beams therein.

Still an additional object of the subject invention is to provide terminals for a bulb socket which prevent damage to locking means prior to or upon insertion of the terminal into the socket housing.

A further object of the subject invention is to provide terminals for a bulb socket that achieve desirably high normal contact forces with the bulb.

SUMMARY OF THE INVENTION

The subject invention is directed to a bulb socket, and to the terminals mountable therein. More particularly, the bulb socket includes a housing into which a pair of substantially identical terminals are mounted. The terminals are stamped and formed from unitary pieces of electrically conductive material and include a crimpable wire engaging end, a housing engaging intermediate portion and an opposed mating end. The wire engaging end may be formed to include a plurality of crimpable arms for achieving crimped electrical connection to the conductor of a wire. The wire engaging end may further include a second plurality of crimpable arms for crimped engagement with the insulator on the wire to achieve higher pulloff strength and strain relief.

The intermediate portion of each terminal is of generally box-like cross-sectional configuration conforming to the interior of the socket housing, as explained further herein. The intermediate portion may further include locking means for locking engagement within the housing of the bulb socket. The locking means may comprise at least one deflectable tang angularly aligned with respect to the longitudinal axis of the terminal so as to deflect in response to contact with the housing upon insertion of the terminal into the housing. However, the locking tang will resiliently return toward its undeflected condition to lockingly engage locking structure within the socket housing to prevent rearward withdrawal of the terminal therefrom. The locking tang of each terminal may be angularly aligned inwardly relative to the stamped and formed terminal. The inward angular alignment of the locking tang is effective to prevent unintentional deformation of the locking tang during handling prior to complete insertion of the terminal into the socket housing.

The mating end of each terminal defines a pair of opposed deflectable contact beams which are cantilevered from the intermediate portion of the terminal. The opposed contact beams may be angularly aligned generally toward one another to define a minor dimension gap at locations thereon remote from the housing engaging intermediate portion of the terminal, but spaced slightly from the extreme mating end of the terminal. To achieve this minor dimension gap the opposed facing surfaces of the contact beams may be formed to be generally convex along their respective lengths. At least portions of the opposed facing surfaces of the contact beams may also be generally concave from side to side. More particularly, at least portions of the opposed facing surfaces of the contact beams adjacent the mating end of the terminal may be of generally arcuate concave configuration from side to side to ensure proper alignment of the small, flexible, conductive leads of the bulb inserted into the terminal. The side to side concave arcuate configuration of the contact beams will effectively realign a bent lead on a bulb, and urge the lead of the bulb into its preferred alignment for achieving optimum contact forces with the contact beams.

The extreme mating end of each contact beam preferably is formed to extend laterally outwardly to define a major dimension entrance to the mating end of the terminal. This wide opening to the mating end of the terminal will cooperate with structure at the mating end of the housing, as explained further herein, to substantially prevent the base of the bulb from being urged behind either contact beam.

The mating end of each terminal further includes a tuning fork assist structure. The tuning fork assist structure may include a root extending from the intermediate portion of the terminal and a pair of tuning fork assist arms cantilevered from the root and extending toward the mating end of the terminal. The tuning fork assist arms are spaced from the contact beams along a major portion of their respective lengths. However, the tuning fork assist arms are connected to the contact beams at the extreme mating end of the terminal. In this manner, the tuning fork assist arms enable more uniform deflection of the contact beams and further cause higher normal contact forces to be exerted by the contact beams. Advantages of tuning fork assist terminals are further explained in co-pending application Ser. Nos. 225,001 and 314,992, the disclosures of which are incorporated herein by reference.

The housing of the subject bulb socket may be unitarily molded from a nonconductive material. More particularly, the housing may be a generally elongated member having a forward mating end and a rearward terminal receiving end. The forward mating end may include appropriate external structure for mounting the housing to a panel or other such support, which may define a portion Of an automotive vehicular electrical component, such as a dashboard panel. The housing further includes a central cavity extending longitudinally therethrough. Portions of the cavity adjacent the forward mating end of the housing may define a cross-sectional configuration generally conforming to the shape of the bulb base to be inserted into the housing. In particular, the forward mating end of the cavity may taper into a generally rectangular cross-sectional configuration to enable the base of the bulb to be guided therein and into mating engagement with the terminals of the socket.

Rearward portions of the cavity in the socket housing are configured to receive a pair of opposed terminals, such as the terminals described above. In particular, rearward portions of the cavity in the housing are configured to guide the terminals into the housing, and securely position the terminals in generally parallel spaced relationship to one another. Interior portions of the housing preferably include a locking means for lockingly engaging corresponding structure on the terminals. Preferably, the locking structure of the housing is disposed generally centrally within the cavity of the housing to engage an inwardly cantilevered deflected locking tang on the terminal, as explained above.

The socket housing preferably defines an inwardly directed shoulder at the interface between the forward mating end of the housing and the terminal receiving cavity The shoulder defines a surface against which the extreme forward mating end of the terminals will abut upon complete insertion. Thus, the shoulder prevents over-insertion of the terminals from the rear of the socket housing. The shoulder further functions to guide the bulb into the cavity, and prevent the base of the bulb from being inserted behind the contact beams of the terminals.

DETAILED DESCRIPTION OF THE PREFERRED EMBODIMENTS

Figure 1:
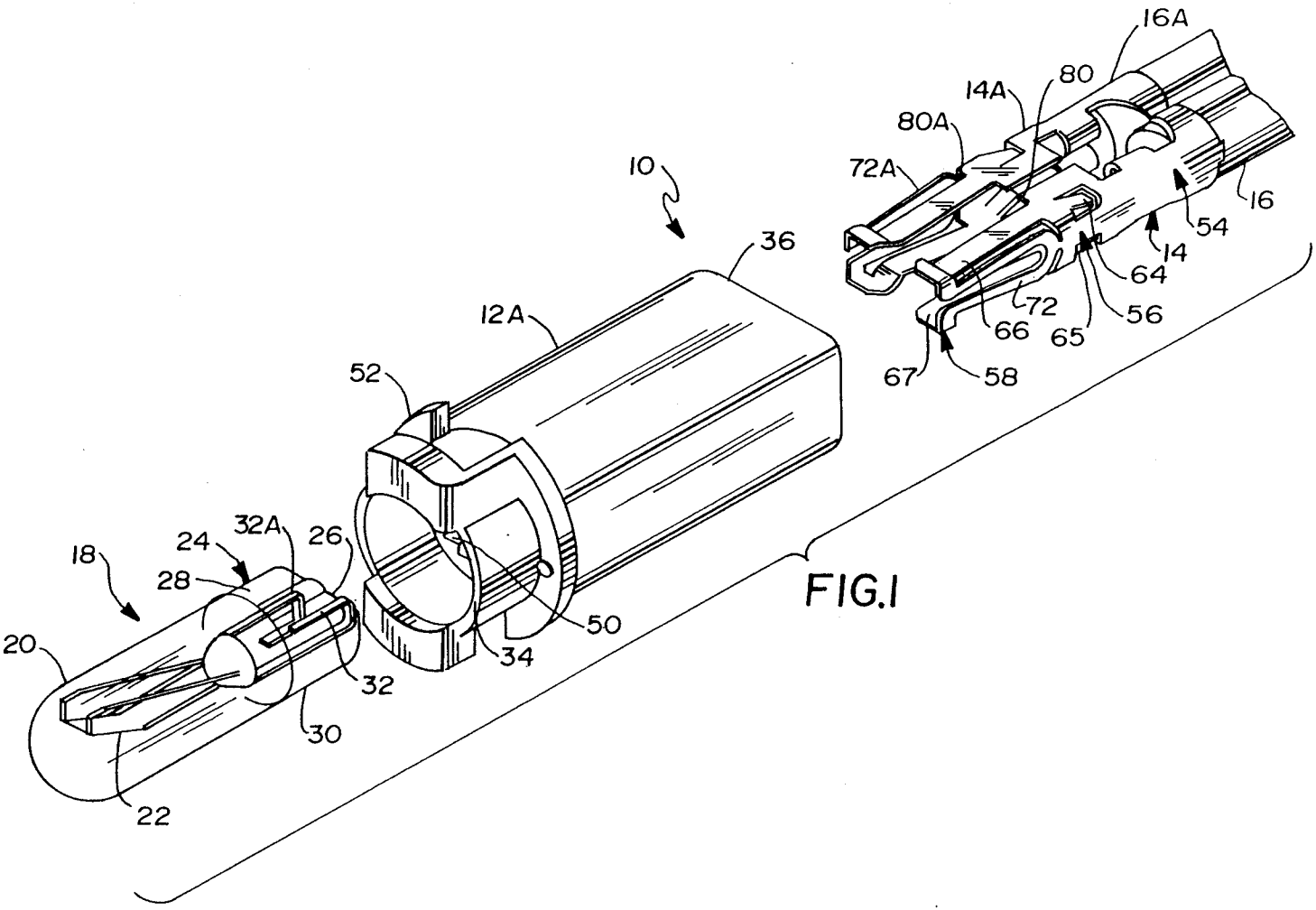
FIG. 1 is an exploded perspective view of a bulb and bulb socket assembly according to the subject invention.

The bulb socket assembly of the subject invention is identified generally by the numeral 10 in FIG. 1. The bulb socket assembly 10 comprises a unitarily molded nonconductive housing 12 and a pair of substantially identical opposed electrically conductive terminals which are indicated generally by the numerals 14 and 14A. The terminals 14 and 14A are connected to insulated wire leads 16 and 16A respectively. The socket assembly 10 of the subject invention is constructed to achieve electrical and mechanical connection to a prior art bulb 18, which is generally of the type employed widely in automotive applications, such as low wattage bulbs employed in automotive dashboards.

The prior art bulb 18 includes a forward illuminating portion 20 having filaments 22 therein. The forward portion 20 of the bulb 18 typically will be generally cylindrical in configuration, although other configurations may be provided in accordance with particular needs of a system. The bulb 18 further includes a base 24 of generally rectangular cross-sectional configuration. The base 24 is molded from a nonconductive material and includes a generally rectangular end surface 26 and opposed generally parallel rectangular side surfaces 28 and 30 which extend forwardly from the extreme end surface 26 toward the illuminating portion 20 of the bulb 18. The base 24 of the bulb 18 further includes a pair of electrically conductive leads 32 and 32A extending from the extreme end surface 26 thereof. The leads 32 and 32A are formed from a very narrow, thin, flexible material and are bent in opposite directions relative to the extreme end surface 26 of the base 24. More particularly, the lead 32 is bent to lie substantially in face to face contact with the side surface 28 of the base 24. On the other hand, the lead 32A is bent to lie in generally face to face contact with the side surface 30 of the base 24. The leads 32 and 32A are not fixedly attached to the side surfaces 28 and 30 of the base 24. Rather, the leads 32 and 32A can be readily deflected during manipulation of the bulb 18 and/or during insertion of the bulb 18 into a socket. In many instances, deflection of the leads 32 and/or 32A can result in improper electrical contact with terminals of a socket, and therefor unacceptable performance of the bulb 18.

Figure 2:
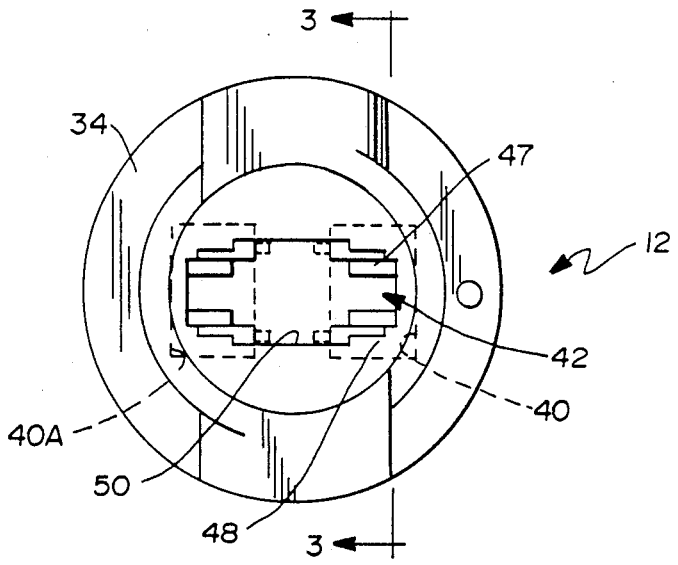
FIG. 2 is a front elevational view of the socket housing of the subject invention.
Figure 3:
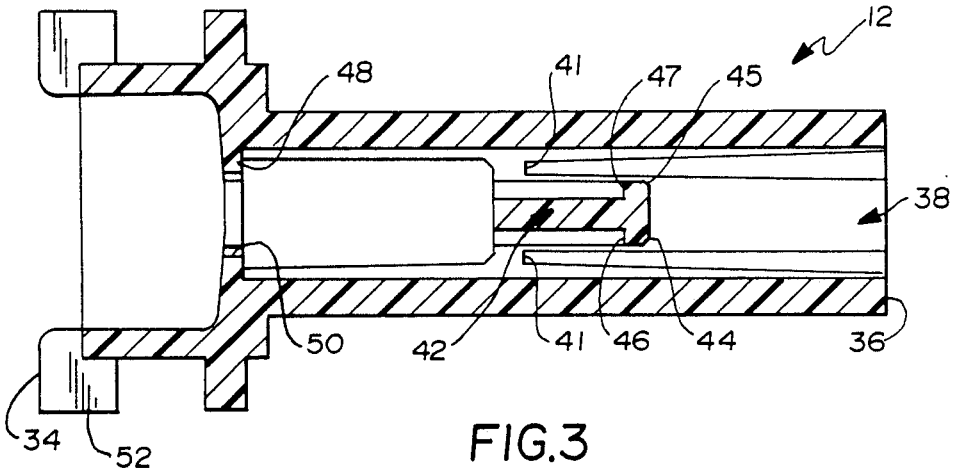
FIG. 3 is a cross-sectional view taken along line 3—3 of FIG. 2.

The housing 12 of the socket assembly 10 is unitarily molded from a plastic material and defines an elongated structure having a forward mating end 34 and a rearward terminal receiving end 36 of generally rectangular cross section, as illustrated in FIGS. 2 and 3. Side walls of the housing define a through cavity, identified generally by the numeral 38, which extends longitudinally through the housing 12 from the forward mating end 34 to the rearward terminal receiving end 36. More particularly, the cavity 38 includes a pair of substantially identical parallel longitudinally extending cavities 40 and 40A as shown in FIGS. 2 and 3. With reference to FIG. 3, the cavity 40 is provided with stop shoulders 41 and with an inward locking structure 42 having a rearwardly facing generally arcuate or ramped surfaces 44 and 45 for generating deflection in locking tangs formed in the terminal 14 as explained further below. The locking structure 42 further includes forwardly facing locking surfaces 46 and 47 which will lockingly engage the tangs on the terminal 14. It is to be understood that substantially identical locking structures are disposed in the terminal receiving cavity 40A.

The housing 12 further includes an inwardly directed shoulder 48 which generally defines the entrance to the cavity 38 from the mating end 34 of the housing 12. The shoulder 48 defines an aperture 50 configured and dimensioned to receive the base 24 of the bulb 18. The shoulder 48 further serves to limit the forward movement of the terminals 14 and 14A into the housing 12. Additionally, the shoulder 48 functions to prevent the base 24 of the bulb 18 from being inserted behind the contact beams of the terminals 14, 14A as explained herein.

The extreme forward end 34 of the housing 12 is further characterized by externally disposed mounting structure 52 which enables the secure mounting of the housing 12 to an appropriate board or panel.

Figure 4:
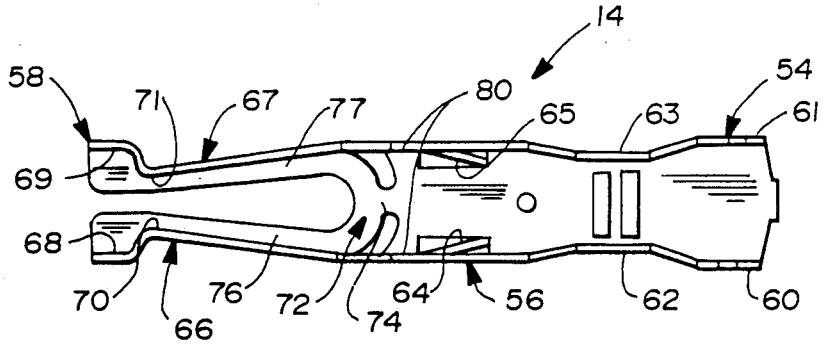
FIG. 4 is a top plan view of the terminal of the subject invention.
Figure 5:
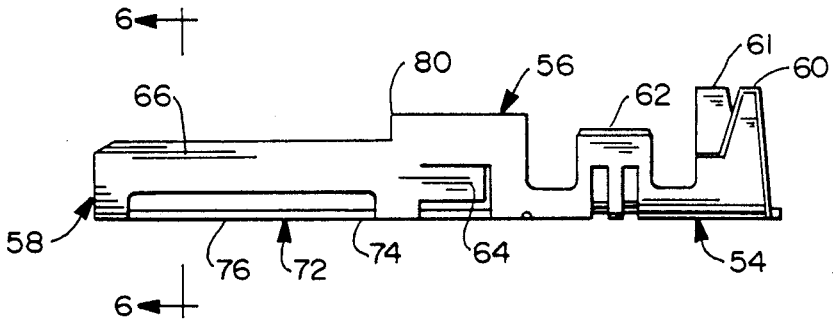
FIG. 5 is a side elevation view of the terminal shown in FIG. 4.
Figure 6:
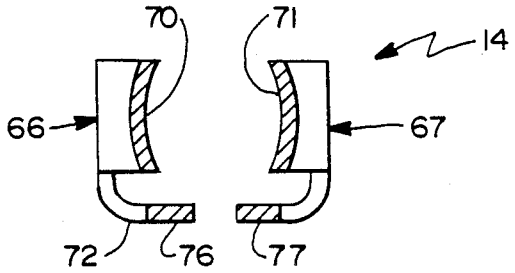
FIG. 6 is a cross-sectional view taken along line 6—6 in FIG. 5.

The terminal 14 of the socket assembly 10 is illustrated in greater detail in FIGS. 4–6. The terminal 14 generally is defined by a rearward wire engaging end 54, an intermediate housing engaging portion 56 and a forward mating end 58. The rearward wire engaging end 54 includes a first pair of crimpable insulation wire engaging arms 60 and 61 and a second pair of crimpable conductor engaging arms 62 and 63. The arms 60–63 are crimpable into engagement with a wire lead 16 which is illustrated generally in FIG. 1. The crimped engagement of the arms 60 and 61 with the insulation on the wire 16 is intended to provide high pulloff strength and strain relief. The crimping of the arms 62 and 63 defines the electrical connection between the wire 16 and the terminal 14.

As shown most clearly in FIG. 4, the intermediate portion 56 of the terminal 14 is characterized by inwardly cantilevered locking tangs 64 and 65 which are angularly aligned toward one another and extend generally toward the rear end 54 of the terminal 14. The locking tangs 64 and 65 are configured to be deflected by the rearwardly facing surfaces 44 and 45 of the locking structure 42 in the housing 12 such that the tangs 64 and 65 will deflect outwardly and away from one another. However, upon sufficient insertion of the terminal 14 into the housing 12, the locking tangs 64 and 65 will clear the locking surfaces 46 and 47 and resiliently return toward their undeflected condition, such that the locking tangs 64 and 65 will locking engage the locking surfaces 46 and 47 on the housing 12 in response to any rearwardly directed forces on the terminal 14. This locking engagement of the tangs 64 and 65 will prevent rearward withdrawal of the terminal 14. Over-insertion of the terminal 14 into the housing 12 will be prevented by contact between the extreme forward ends 80 of the housing engaging portion 56 of the terminal 14 with the stop shoulders 41' of the housing 12.

The terminal 14 is further characterized by substantially identical contact beams 66 and 67 which are cantilevered to extend forwardly from the intermediate portion 56 of the terminal 14. The contact beams 66 and 67 are angularly aligned to the longitudinal axis of the terminal 14 to extend generally symmetrically toward one another. However, the extreme forward ends of the contact beams 66 and 67 are flared outwardly at locations 68 and 69 respectively. The outward flaring of the contact beams 66 and 67 begins at contact surfaces 70 and 71 which define the minor dimension gap between the contact beams 66 and 67. In particular, the contact surfaces 70 and 71 will define portions of the terminal 14 that may contact the conductive leads of a bulb inserted into the socket assembly 10. The above described configuration of the contact beams 66 and 67 results in the opposed facing surfaces of the contact beams 67 being generally inwardly convex along their respective lengths. However, the opposed facing surfaces of the contact beams 66 and 67 are generally concave from side to side, at least in the vicinity of the contact surfaces 70 and 71 as shown most clearly in FIG. 6. The side to side concave configuration of inwardly facing surfaces of the contact beams 66 and 67 will function to realign the conductive leads 32 and 32A of the bulb 18 as the bulb 18 is being inserted into the socket assembly 10. As a result of this configuration, the conductive leads 32 and 32A of the bulb 18 will be positively assured of being engaged by the contact beams 66 and 67, and cannot be deflected out of engagement with the contact beams 66 and 67 as the bulb 18 is urged into the socket assembly 10.

The mating end 58 of the terminal 14 is further characterized by a tuning fork assist structure 72. The tuning fork assist structure includes a root portion 74 which is unitarily connected to and extends from the intermediate portion 56 of the terminal 14. The tuning fork assist structure 72 further includes a pair of parallel generally planar arms 76 and 77 which extend forwardly from the root 74 thereof. The arms 76 and 77 run generally adjacent to but spaced from the contact beams 66 and 67 for most of their respective lengths, and lie in a plane that is generally orthogonal to the respective planes defined by the contact beams 66 and 67. The arms 76 and 77 are unitarily connected to portions of the contact beams 66 and 67 at the extreme mating end 58 of the terminal 14. The stamped generally planar configuration of the tuning fork assist structure 72 enables substantial accuracy to be achieved in its alignment, dimensions and the relative spacing between the arms 76 and 77 thereof. The tuning fork assist structure 72 therefore provides exceptional control for the spacing between the contact beams 66 and 67 of the terminal 14. Additionally, the arms 76 and 77 result in substantially higher normal contact forces being generated within the contact beams 66 and 67. In particular, the deflection of the contact beams 66 and 67 will require corresponding deflection of the arms 76 and 77 in the plane of the metal from which the assist structure 72 is stamped. This deflection within the plane of the metal enables the generation of substantially higher normal contact forces against the conductive leads 32 and 32A of the bulb 18.

Figure 7:
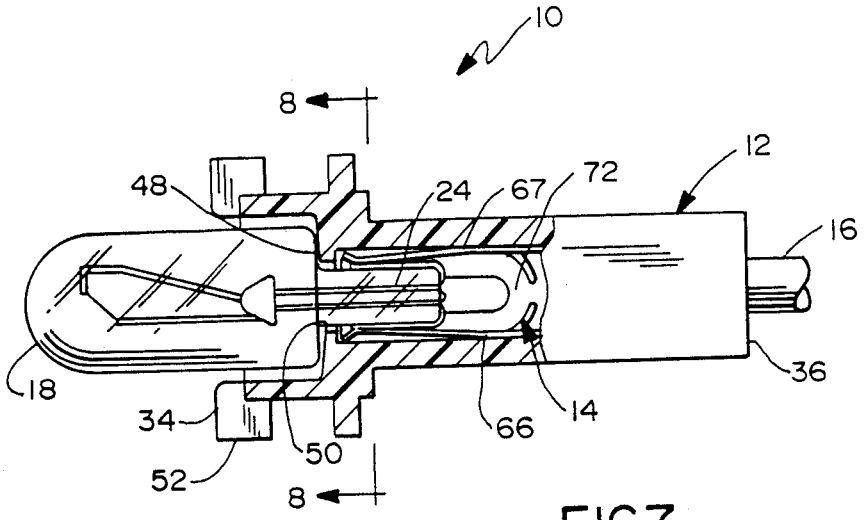
FIG. 7 is a cross-sectional view of the bulb socket assembly with the bulb mounted therein.
Figure 8:
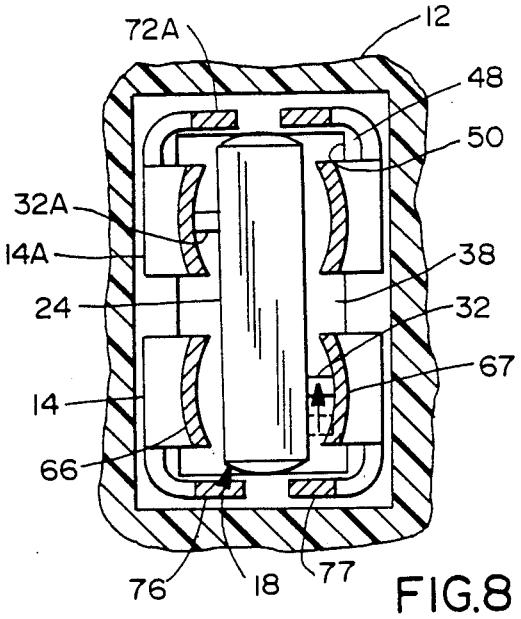
FIG. 8 is a cross-sectional view taken along line 8—8 in FIG. 7.

FIGS. 7 and 8 show the terminals 14, 14A fully seated in the housing 12 and the bulb 18 in its fully seated position in the socket assembly 10. It will be noted that the tuning fork assist structures 72, 72A are disposed in outboard locations adjacent the housing side walls such that the base 24 of the bulb 18 can be inserted therebetween. More particularly, the base 24 of the bulb 18 is inserted into the aperture 50 defined in the shoulder 48. The provision of the shoulder 48 and the relative position of the extreme mating end 58 of the terminal 14 in the housing 12 substantially prevents the base 24 of the bulb 18 from being inserted behind either contact beam 66 or 67. Continued insertion of the base 24 of the bulb 18 will cause deflection of the contact beams 66 and 67, with the normal forces exerted by the contact beams 66 and 67 against the base 24 of the bulb 18 being assisted by the tuning fork assist structure 72. Additionally, as shown most clearly in FIG. 8, the side to side concave configuration of the contact beams 66 and 67 in the vicinity of the contact surfaces 70 and 71 thereof will effectively urge the conductive leads 32 and 32A of the bulb into more central configurations for ensuring high quality normal contact with the conductive leads 32 and 32A.

In summary, a socket assembly is provided for low wattage bulbs. The socket assembly includes a molded nonconductive housing and a pair of substantially identical opposed electrically conductive terminals lockingly engaged therein. The housing includes an inwardly directed shoulder adjacent the forward mating end thereof and an inwardly disposed locking structure. The terminals include an inwardly cantilevered locking tang for engagement with the inwardly disposed locking structure of the housing The inward orientation of the locking tang prevents deformation during handling or insertion. The mating end of the terminals include opposed contact beams that are cantilevered to extend generally toward one another. However, the extreme forward end of the contact beams are formed outwardly and away from one another for direct engagement behind the shoulder at the mating end of the housing. The opposed facing surfaces of the contact beams are further of generally concave configuration from side to side such that the contact beams will urge the conductive leads of the bulb generally inwardly on the base of the bulb and into proper mating alignment with the terminals. The terminals further include tuning fork assist structures orthogonally aligned to the plane of the contact beams. The tuning fork assist extends from an intermediate portion of the terminal and includes a pair of arms connected respectively to the contact beams at the extreme mating ends thereof.

While the invention has been described with respect to a preferred embodiment, it is apparent that various changes can be made without departing from the scope of the invention as defined by the appended claims.

I claim:

1. A bulb socket assembly comprising a nonconductive housing having a cavity extending therethrough, a pair of electrically conductive terminals mounted in the cavity of the housing for engaging a pair of conductive leads disposed externally on a base portion of a bulb, wherein the improvement comprises:

said terminals being substantially identical and being disposed in opposed relationship to one another in the housing, each said terminal including a pair of opposed deflectable contact beams dimensioned to receive the base portion of the bulb therebetween, opposed facing surfaces of said contact beams being concavely arcuate from side to side for urging the conductive leads of the bulb inserted therein into alignment with central locations on the contact beams.

2. A socket assembly as in claim 1 wherein the opposed facing surfaces of the contact beams are generally convex along their respective lengths.

3. A socket assembly as in claim 1 wherein each said terminal includes an intermediate portion from which said contact beams are cantilevered, each said terminal further including a tuning fork assist structure having a root portion connected to the intermediate portion of said terminal and a pair of arms extending forwardly toward the mating end of the terminal from the root portion, each said arm of said tuning fork assist structure being connected to one of said contact beams at locations thereon remote from said intermediate portion of said terminal, and being spaced from the respective contact beams at locations thereon spaced rearwardly from the extreme forward mating end of the terminal.

4. A socket assembly as in claim 3 wherein the tuning fork assist structure is generally planar and is disposed in a plane aligned substantially orthogonal to the contact beams.

5. A socket assembly as in claim 4 wherein the terminals are mounted in the housing in opposed relationship to one another, such that the tuning fork assist structures are adjacent external walls of the housing, and such that the base of the bulb can be inserted into the housing and intermediate the tuning fork assist structures of the terminals.

6. A socket assembly as in claim 1 wherein each said terminal includes at least one rearwardly extending inwardly directed locking tang, and wherein said housing includes at least one inwardly disposed locking surface for locking engagement with the locking tang, whereby the inward alignment of the locking tang prevents deformation of the locking tang prior to insertion of the terminal into the housing.

7. A socket assembly as in claim 1 wherein the housing includes an inwardly directed shoulder generally adjacent the forward mating end of the housing, and wherein the forward mating end of each said terminal is dimensioned to be engaged against the shoulder of the housing, whereby the alignment of the forward mating end of each terminal with the housing substantially guides the base of the bulb intermediate the contact beams of the terminal.

8. A bulb socket assembly for receiving a base portion of a bulb, said base portion of said bulb including a pair of conductive leads disposed externally thereon, said bulb socket assembly including a nonconductive housing having a forward mating end and a rearward terminal receiving end and a side wall portion extending therebetween defining a cavity, a pair of electrically conductive terminals mounted in the cavity of the housing for electrically contacting the leads of the bulb upon insertion Of the base of the bulb into the forward mating end of the cavity, wherein the improvement comprises:

said housing being provided with a shoulder extending inwardly into the cavity generally adjacent the mating end of the housing and a locking structure disposed within the cavity and spaced inwardly from the side wall portions of the housing; and said terminals each including a rearward conductor engaging end, an intermediate housing locking portion and a forward mating end, said intermediate portion being characterized by an inwardly directed deflectable locking tang lockingly engaged with the locking structure of the housing for preventing rearward withdrawal of the terminal from the housing, said forward mating end of each said terminal including a pair of elongated contact beams extending from the intermediate portion of the terminal, said contact beams including opposed facing surfaces of generally convex configuration along the length of each said contact beam, such that a minor dimension gap is defined between the opposed surfaces of said contact beams, the opposed facing surfaces of said contact beams being of generally concave arcuate side to side configuration at locations thereon adjacent the minor dimension gap, and portions of said contact beams remote from said intermediate portion of said terminal being generally aligned with the shoulder of said housing, said terminals each further including a tuning fork assist structure including a pair of arms connected respectively to the contact beams at locations thereon remote from said intermediate portion of said terminal, said arms of said tuning fork assist structure extending rearwardly from the respective connections to the contact beams to a root portion generally adjacent the intermediate portion of said terminal, said terminals being mounted in the housing such that the contact beams of each terminal are disposed intermediate the tuning fork assist structures thereof, such that the base of the bulb is insertable between the tuning fork assist structures and the respective contact beams, whereby the shoulder of the housing ensures proper alignment of the bulb to the terminals, and whereby the arcuate concave side to side configuration of said contact beams aligns the leads of said bulb with said contact beams.

9. A socket assembly as in claim 8 wherein the root portion of each said tuning fork assist structure is unitarily connected to the intermediate portion of the respective terminal.

10. A socket assembly as in claim 8 wherein each said tuning fork assist structure is generally planar and is aligned generally orthogonal to said contact beams.

* * * * *